US009146504B2

(12) United States Patent
Kuramashi

(10) Patent No.: US 9,146,504 B2
(45) Date of Patent: Sep. 29, 2015

(54) DEVELOPING DEVICE HAVING MAGNETIC ROLLER AND IMAGE FORMING APPARATUS

(71) Applicant: KYOCERA Document Solutions Inc., Osaka (JP)

(72) Inventor: Koji Kuramashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/512,313

(22) Filed: Oct. 10, 2014

(65) Prior Publication Data

US 2015/0104221 A1 Apr. 16, 2015

(30) Foreign Application Priority Data

Oct. 11, 2013 (JP) ..... 2013-213289

(51) Int. Cl.
*G03G 15/08* (2006.01)
*G03G 15/09* (2006.01)

(52) U.S. Cl.
CPC ..... *G03G 15/0928* (2013.01); *G03G 15/0818* (2013.01)

(58) Field of Classification Search
USPC ..... 399/276
See application file for complete search history.

(56) References Cited

U.S. PATENT DOCUMENTS 5,177,536 A 1/1993 Watanabe et al.

FOREIGN PATENT DOCUMENTS

JP 02-262171 10/1990
JP 2007322725 A * 12/2007

* cited by examiner

*Primary Examiner* — Quana M Grainger
(74) *Attorney, Agent, or Firm* — Knobbe, Martens Olson & Bear LLP

(57) ABSTRACT

A developing device includes a developing roller. The developing roller includes a magnetic roller configured to have multiple magnetic poles in a circumferential direction thereof and a roller-shaped developing sleeve sheathed on the magnetic roller, and supplies magnetic toner to a photosensitive drum. Further, the developing sleeve is configured such that a surface of an image region thereof, which is located in an intermediate portion thereof in a rotation axis direction thereof and which supplies the magnetic toner to the photosensitive drum, is coated with a non-magnetic material, and such that surfaces of non-image regions thereof, which are located at opposite ends thereof in the rotation axis direction and which supply no magnetic toner to the photosensitive drum, are coated with a magnetic material.

14 Claims, 6 Drawing Sheets

DEVELOPING DEVICE HAVING MAGNETIC ROLLER AND IMAGE FORMING APPARATUS

INCORPORATION BY REFERENCE

This application claims priority to Japanese Patent Application No. 2013-213289 filed on Oct. 11, 2013, the entire contents of which are incorporated by reference herein.

BACKGROUND

The present disclosure relates to a developing device that forms a toner image by feeding magnetic toner toward an electrostatic latent image formed on a circumferential surface of a photosensitive drum by electrophotography and an image forming apparatus having the same, and particularly to a technique for suppressing turbulence of a toner layer at opposite ends of a developing sleeve.

In electrophotographic image forming apparatuses, a toner image is formed by feeding magnetic toner from a developing device toward an electrostatic latent image formed on a surface of a photosensitive drum. Such a developing device has a developing roller made up of a magnetic roller and a developing sleeve, forms a toner layer on a circumferential surface of the developing sleeve, and feeds the magnetic toner from the developing sleeve to the surface of the photosensitive drum. In order to prevent toner leakage when the magnetic toner on the circumferential surface of the developing sleeve moves to opposite ends of the developing sleeve in a rotation axis direction of the developing sleeve, technology for disposing seal members formed of a magnetic material at the opposite ends of the developing sleeve in the rotation axis direction of the developing sleeve in a non-contact way is known. Thereby, magnetic brushes are formed between the magnetic roller and the developing sleeve, and inhibit the magnetic toner on the circumferential surface of the developing sleeve from moving to the opposite ends of the developing sleeve in the rotation axis direction of the developing sleeve.

SUMMARY

Technology that further improves the aforementioned technology is proposed as one aspect of the present disclosure.

A developing device according to one aspect of the present disclosure includes a developing roller.

The developing roller includes a magnetic roller configured to have multiple magnetic poles in a circumferential direction thereof and a roller-shaped developing sleeve sheathed on the magnetic roller, and supplies magnetic toner to a photosensitive drum.

Thus, the developing sleeve is configured such that a surface of an image region thereof, which is located in an intermediate portion thereof in a rotation axis direction thereof and which supplies the magnetic toner to the photosensitive drum, is coated with a non-magnetic material, and such that surfaces of non-image regions thereof, which are located at opposite ends thereof in the rotation axis direction and which supply no magnetic toner to the photosensitive drum, are coated with a magnetic material.

Further, an image forming apparatus according to another aspect of the present disclosure includes a photosensitive drum, a charging unit, an exposing unit, and the aforementioned developing device.

The photosensitive drum has a surface on which a toner image is formed.

The charging unit charges the surface of the photosensitive drum.

The exposing unit exposes the surface of the photosensitive drum which is charged by the charging unit, thereby forming an electrostatic latent image.

The developing device supplies magnetic toner to the electrostatic latent image formed by the exposing unit, thereby forming a toner image.

DETAILED DESCRIPTION

Figure 1:
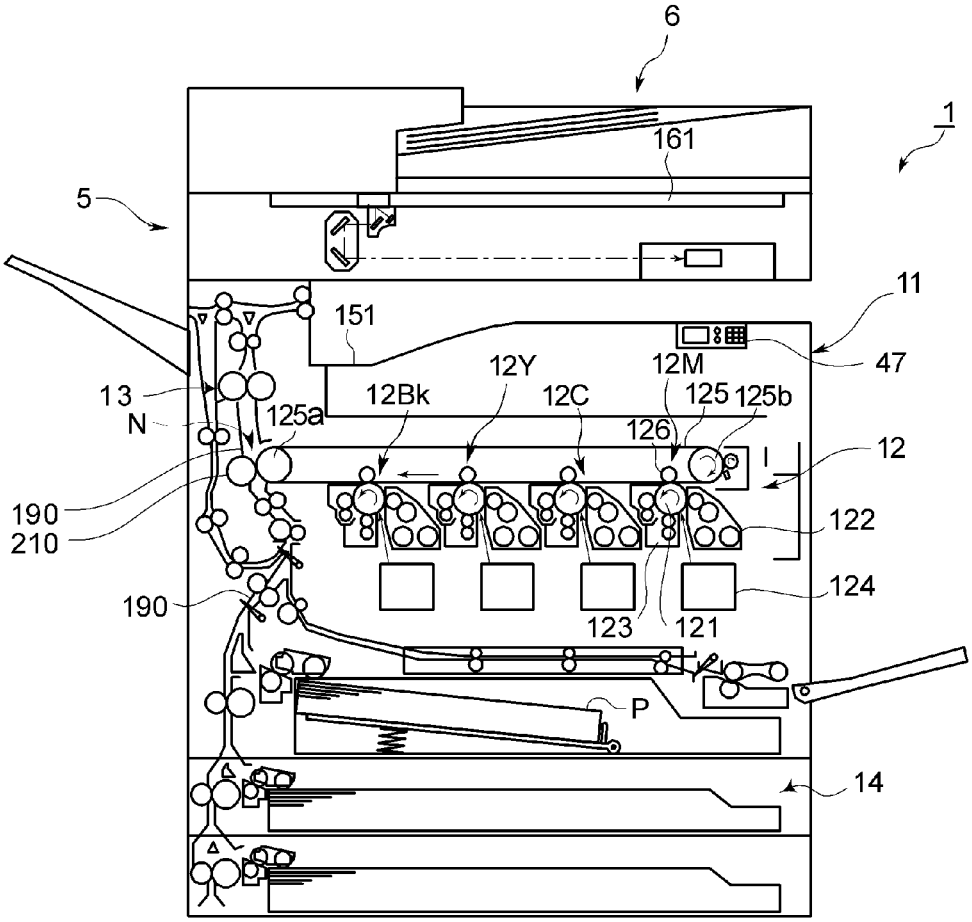
FIG. 1 is a front cross-sectional view illustrating a structure of an image forming apparatus having a developing device according to an embodiment of this disclosure.

Hereinafter, a developing device and an image forming apparatus having the same according to an embodiment of this disclosure will be described with reference to the drawings. FIG. 1 is a front cross-sectional view illustrating a structure of an image forming apparatus having a developing device according to an embodiment of this disclosure.

An image forming apparatus 1 according to an embodiment of this disclosure is, for instance, a multifunction peripheral combining multiple functions such as a copy function, a printer function, a scanner function, and a facsimile function. The image forming apparatus 1 includes an apparatus main body 11 equipped with an operation unit 47, an image forming unit 12, a fixing unit 13, a paper feed unit 14, a document feed unit 6, and a document scanning unit 5.

When the image forming apparatus 1 performs a document scanning operation, the document scanning unit 5 optically scans an image of a document fed by the document feed unit 6 or an image of a document placed on a document table glass 161 to generate image data. The image data generated by the document scanning unit 5 is stored in an internal hard disk drive (HDD) or a networked computer.

When the image forming apparatus 1 performs an image forming operation, the image forming unit 12 forms toner images on recording paper P fed from the paper feed unit 14 as a recording medium based on the image data generated by the document scanning operation or the image data stored in the internal HDD. Each of image forming units 12M, 12C, 12Y, and 12Bk of the image forming unit 12 is equipped with a photosensitive drum 121, a charging device 123, an exposing device 124, a developing device 122, and a primary transfer roller 126.

The developing device 122 of each of the image forming units 12M, 12C, 12Y, and 12Bk contains magnetic toner according to this disclosure. The developing device 122 supplies the corresponding toner to a surface of the photosensitive drum 121 that has been charged by the charging device 123 and exposed by the exposing device 124.

When color printing is carried out, the image forming unit 12M for magenta, the image forming unit 12C for cyan, the image forming unit 12Y for yellow, and the image forming unit 12Bk for black of the image forming unit 12 cause the toner images to be formed on the photosensitive drums 121 by charging, exposing, and developing processes based on images composed of respective color components constituting the image data, and cause the toner images to be transferred to an intermediate transfer belt 125, which is stretched on a driving roller 125*a* and a driven roller 125*b*, by the primary transfer rollers 126.

The intermediate transfer belt 125 has image carrying surfaces to which the toner images are transferred and which are set for an outer circumferential surface thereof, and is driven by the driving roller 125*a* in contact with circumferential surfaces of the photosensitive drums 121. The intermediate transfer belt 125 is synchronized with each photosensitive drum 121 and endlessly travels between the driving roller 125*a* and the driven roller 125*b*.

Transfer timings of the toner images of the respective colors which are transferred onto the intermediate transfer belt 125 are adjusted, and the images are superposed on the intermediate transfer belt 125 to become a color toner image. A secondary transfer roller 210 causes the color toner image formed on the surface of the intermediate transfer belt 125 to be transferred to the recording paper P, which is conveyed from the paper feed unit 14 along a conveying path 190, at a nip zone N across the intermediate transfer belt 125 between the secondary transfer roller 210 and the driving roller 125*a*. Afterwards, the fixing unit 13 causes the toner image on the recording paper P to be fixed to the recording paper P by thermocompression. The recording paper P on which the color image going through the fixing process is formed is ejected to an eject tray 151.

Figure 2:
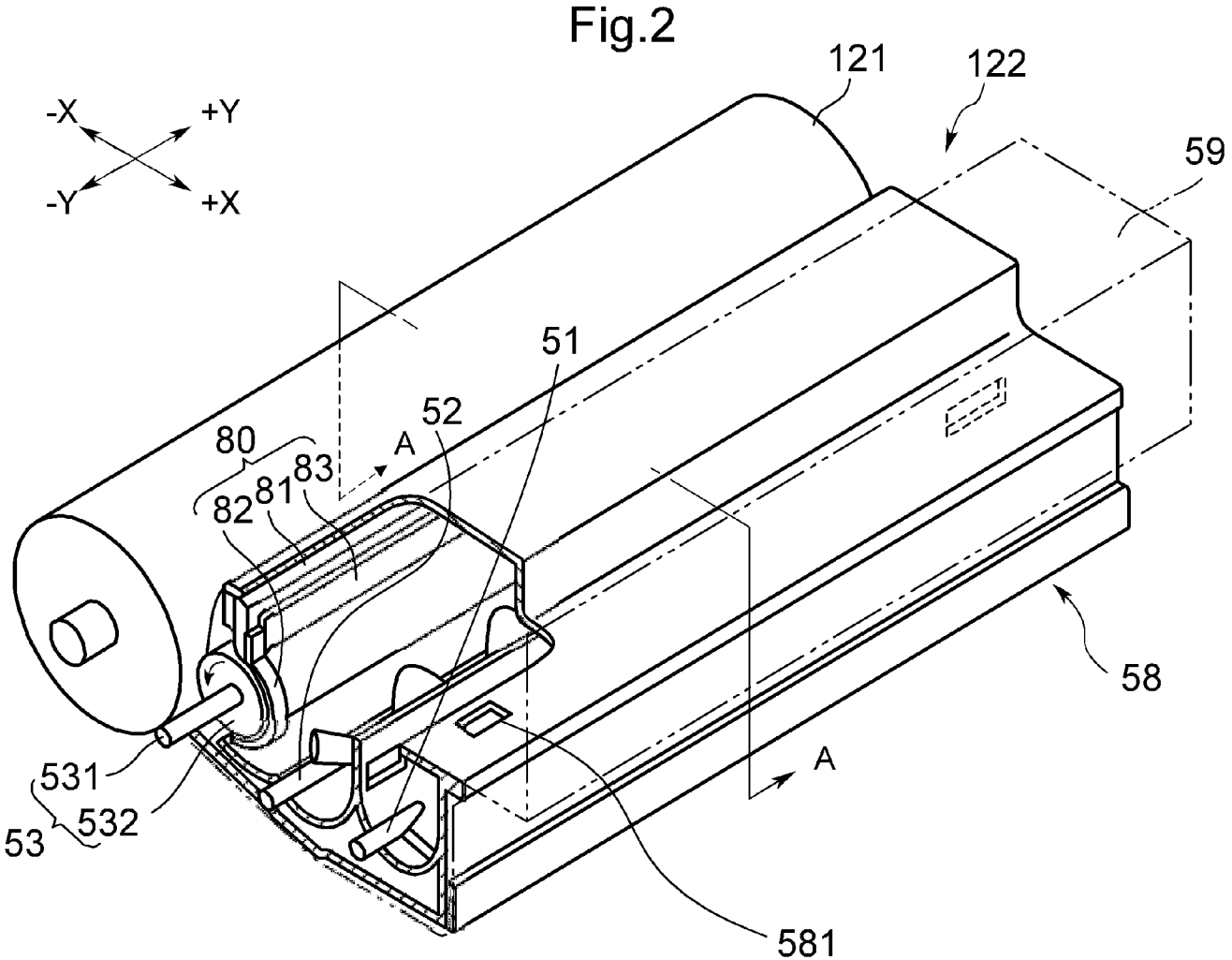
FIG. 2 is a perspective view illustrating a cutout part of the developing device.
Figure 3:
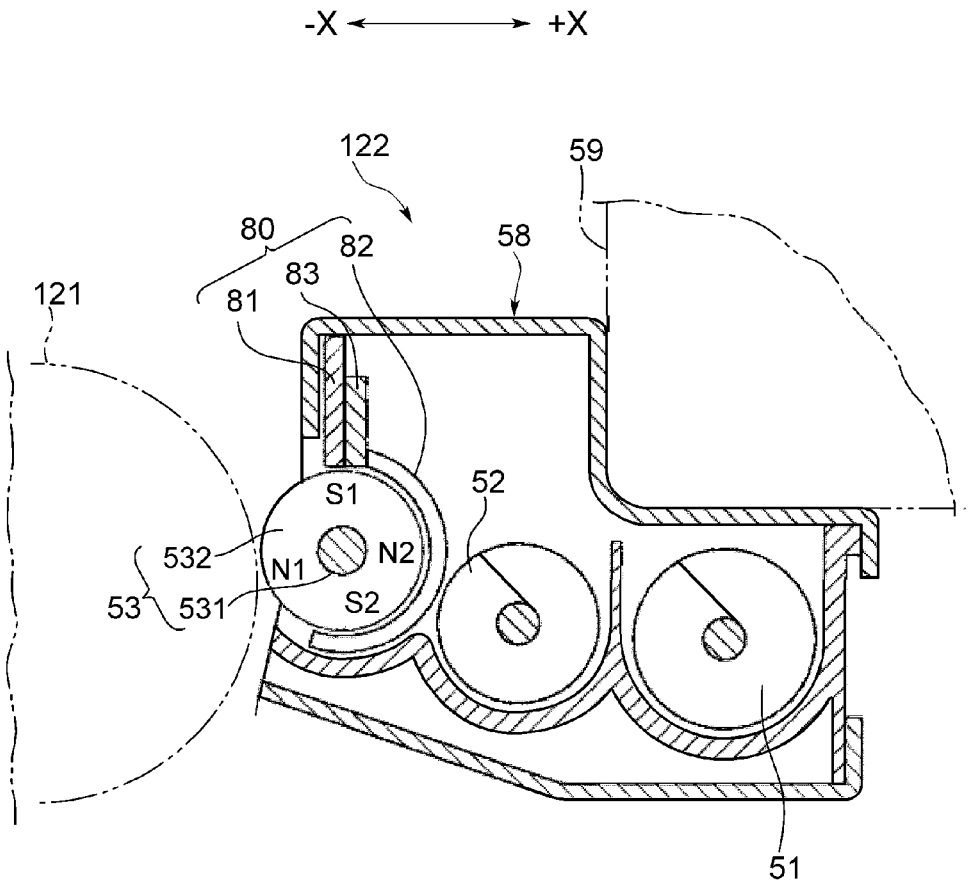
FIG. 3 is a cross-sectional view taken along line A-A in FIG. 2.

Next, a constitution of the developing device 122 will be described. FIG. 2 is a perspective view illustrating a cutout part of the developing device 122. FIG. 3 is a cross-sectional view taken along line A-A in FIG. 2. In FIGS. 2 and 3, an X-X direction is referred to as a leftward/rightward direction, and a Y-Y direction is referred to as a frontward/rearward direction. Particularly, a −X direction is referred to as a left side, a +X direction as a right side, a −Y direction as a front side, and a +Y direction as a rear side.

As illustrated in FIGS. 2 and 3, the developing device 122 is equipped with a first spiral feeder 51, a second spiral feeder 52, and a developing roller 53 in a casing 58.

The first spiral feeder 51 conveys magnetic toner replenished from a toner container 59 toward the rear side while agitating the magnetic toner. The second spiral feeder 52 conveys the magnetic toner delivered from the first spiral feeder 51 toward the front side. The developing roller 53 receives the magnetic toner conveyed by the second spiral feeder 52 and supplies the magnetic toner to a latent image region 1211 (see FIG. 4 to be described below) of the circumferential surface of the photosensitive drum 121.

The developing roller 53 includes a magnetic roller 531 and a developing sleeve 532. The developing sleeve 532 is sheathed on the magnetic roller 531. The developing sleeve 532 is rotatably supported by the casing 58 at a position adjacent to the surface of the photosensitive drum 121 and the second spiral feeder 52.

The magnetic roller (magnet) 531 is a permanent magnet that is fixedly installed in the developing sleeve 532. The magnetic roller 531 has multiple magnetic poles made up of S and N poles that are alternately arranged in a circumferential direction thereof, and generates a magnetic field toward the developing sleeve 532. To supply the magnetic toner to the photosensitive drum 121, a developing bias obtained by superposing alternating current on direct current is applied to the developing sleeve 532.

For example, a magnetic pole S1 is disposed at a position at which the magnetic roller 531 is opposite to a regulating blade 81. Further, a magnetic pole N1 is disposed at a position facing the latent image region 1211. Furthermore, a magnetic pole S2 is disposed on a toner circulation region to which toner remaining after development is conveyed. In addition, a magnetic pole N2 is disposed at a position facing the second spiral feeder 52.

The magnetic toner, which is fed from the toner container 59 through a toner feed opening 581 of the casing 58 by a magnetic force of the magnetic roller 531 and moves from the first and second spiral feeders 51 and 52, is carried on the circumferential surface of the developing sleeve 532.

The regulating blade 81 regulates the magnetic toner carried on the circumferential surface of the developing sleeve 532 to a predetermined layer thickness, and is supported above the developing sleeve 532 by the casing 58 at a predetermined distance from the surface of the developing sleeve 532.

As a developing bias is applied to the developing sleeve 532, a potential difference occurs between the developing sleeve 532 and the photosensitive drum 121. The magnetic toner on the developing sleeve 532 moves to the photosensitive drum 121, and an electrostatic latent image on the photosensitive drum 121 is developed into a toner image.

A toner quantity adjustment mechanism 80 including the regulating blade 81 is arranged at a position facing the circumferential surface of the developing sleeve 532. The toner quantity adjustment mechanism 80 will be described using FIG. 4.

Figure 4:
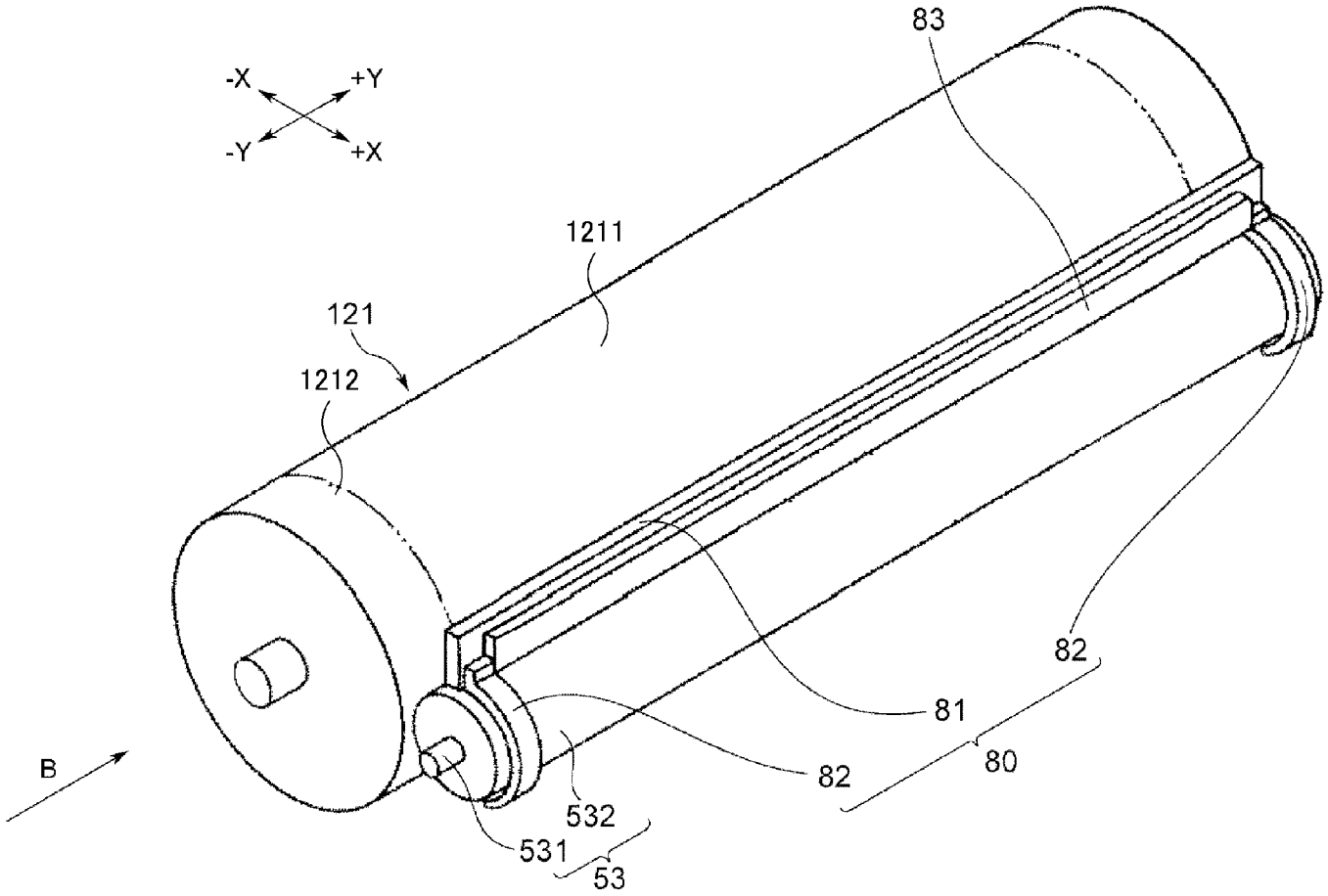
FIG. 4 is a perspective view illustrating portions of a toner quantity adjustment mechanism, a developing roller, and a photosensitive drum.

As illustrated in FIG. 4, the toner quantity adjustment mechanism 80 includes the regulating blade 81, seal members 82, and a blade magnet 83.

The seal members 82 are made of a magnetic member, and are disposed at respective opposite ends of the developing sleeve 532 in a rotation axis direction of the developing sleeve 532 to face the circumferential surface of the developing sleeve 532. The seal members 82 inhibit the magnetic toner on the circumferential surface of the developing sleeve 532 from moving to the ends in the rotation axis direction.

The blade magnet 83 is made of a magnetic member, and is mounted on the regulating blade 81 between arrangement positions of the seal members 82 in a longitudinal direction of the regulating blade 81. The blade magnet 83 is a lateral part of the regulating blade 81, and is mounted on a side becoming an upstream side in a direction in which the circumferential surface of the developing sleeve 532 rotates. The blade magnet 83 is configured such that its edge adjacent to the developing sleeve 532 becomes the same S pole as the magnetic pole S1 of the magnetic roller 531 inside the developing sleeve 532, and the other edge opposite thereto becomes an N pole.

The regulating blade 81 regulates a quantity of the magnetic toner fed to the latent image region 1211 (the region in which the electrostatic latent image is formed between two-dot chain lines illustrated in FIG. 4) of the circumferential surface of the photosensitive drum 121 by the rotation of the circumferential surface of the developing sleeve 532, and prevents the magnetic toner from being fed excessively. The regulating blade 81 is provided to cross the developing sleeve 532 in the rotation axis direction of the developing sleeve 532 at a position facing the circumferential surface of the developing sleeve 532. A tip edge of the regulating blade 81 is formed in an edge shape, and is opposite to the circumferential surface of the developing sleeve 532. The tip edge is provided at a predetermined distance from the circumferential surface of the developing sleeve 532.

The seal members 82 prevent the magnetic toner from moving from a middle circumferential surface to the ends of the developing sleeve 532 in the rotation axis direction of the developing sleeve 532 until the magnetic toner on the circumferential surface of the developing sleeve 532 reaches the arrangement position of the regulating blade 81. The seal members 82 are formed in an arcuate shape in which a central angle of curvature is set to about 180° when viewed from the front (seen in direction B of FIG. 4). Lower ends of the seal members 82 are supported by a part of the casing 58. Thereby, the seal members 82 are arranged at a fixed distance from the circumferential surface of the developing sleeve 532. The corresponding distance is set to, for instance, 0.1 mm to 1.0 mm.

According to the seal members 82, magnetic brushes are formed by the lines of magnetic force between the seal members 82 and the magnetic roller 531 mounted in the developing sleeve 532. Since the magnetic brushes regulate the movement of the magnetic toner toward the ends of the developing sleeve 532 in the rotation axis direction of the developing sleeve 532, the magnetic toner is prevented from moving from the circumferential surface to the ends of the developing sleeve 532.

Figure 5:
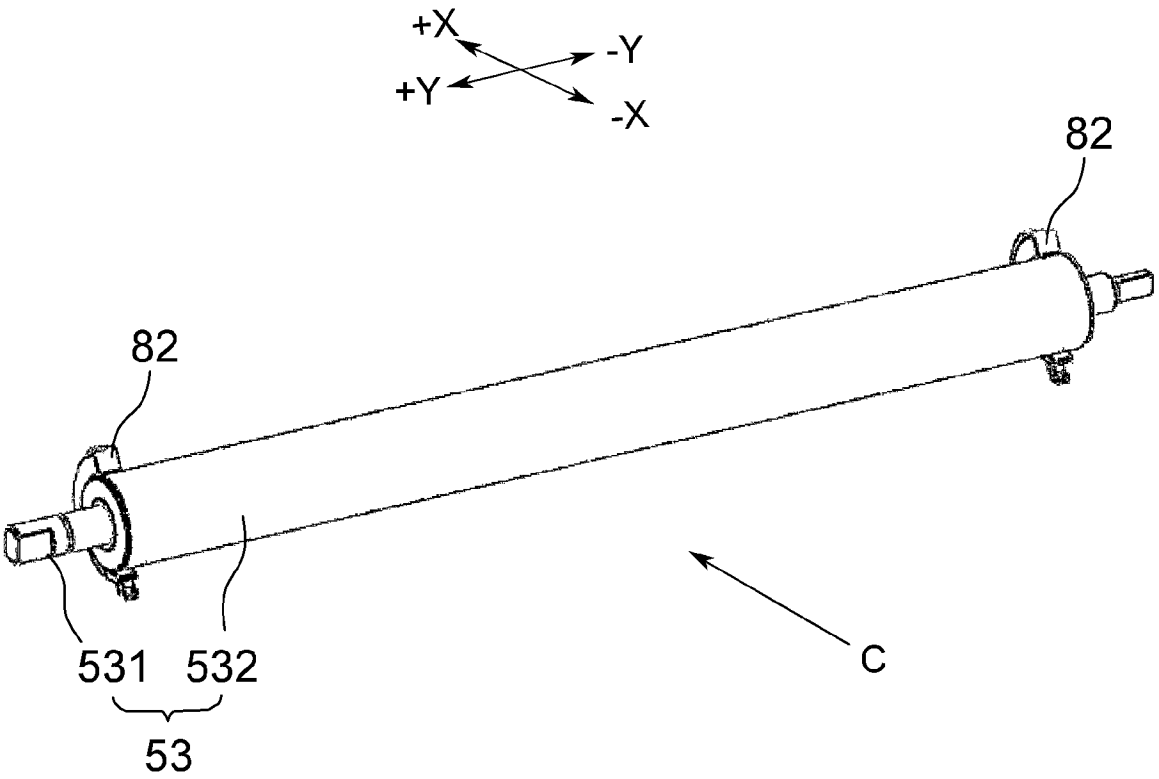
FIG. 5 is a perspective view illustrating portions of the developing roller and seal members.
Figure 6:
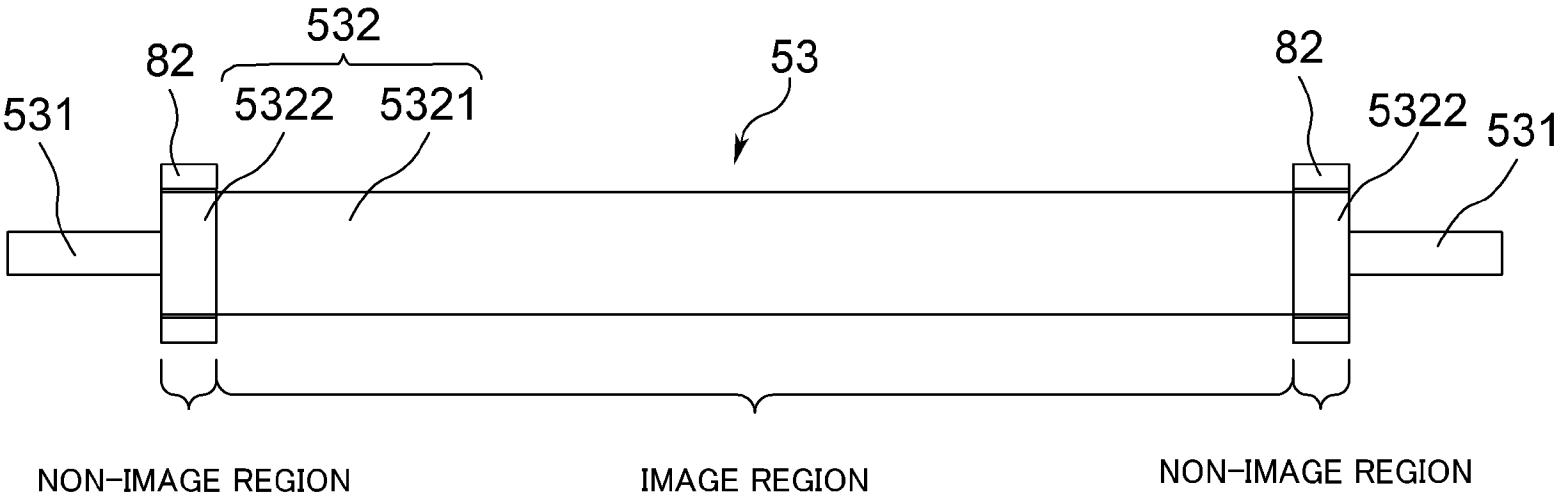
FIG. 6 is a side view of the portions of the developing roller and the seal members seen in a direction of arrow C of FIG. 5.

Next, a detailed constitution of the developing roller 53 will be described. FIG. 5 is a perspective view illustrating portions of the developing roller 53 and the seal members 82. FIG. 6 is a side view of the portions of the developing roller 53 and the seal members 82 seen in a direction of arrow C of FIG. 5.

As illustrated in FIG. 6, the developing sleeve 532 of the developing roller 53 includes an image region 5321 located at an intermediate portion in the rotation axis direction thereof, and non-image regions 5322 located at the opposite ends in the rotation axis direction thereof. The image region 5321 is opposite to the latent image region 1211 (see FIG. 4) of the circumferential surface of the photosensitive drum 121, and supplies the magnetic toner to the photosensitive drum 121. The non-image regions 5322 are opposite to non-latent image regions 1212 (regions in which no electrostatic latent image is formed outside two-dot chain lines illustrated in FIG. 4) of the circumferential surface of the photosensitive drum 121, and supply no magnetic toner to the photosensitive drum 121.

Here, the developing sleeve 532 of the developing roller 53 includes a cylindrical base formed of a non-magnetic material such as aluminum, and a coating layer coating a circumferential surface of the base. Depending on a position of the circumferential surface of the developing sleeve 532, a material of the coating layer coating the circumferential surface of the base differs.

Specifically, a surface of the image region 5321 of the developing sleeve 532 is coated with a non-magnetic material, and surfaces of the non-image regions 5322 are coated with a magnetic material. As the magnetic material for coating the surfaces of the non-image regions 5322, for example, nickel, cobalt, iron, or a nickel-phosphorus alloy having a low phosphorus content may be used. Here, in the nickel-phosphorus alloy having a low phosphorus content, the phosphorus content is lower than that of a nickel-phosphorus alloy used in the image region 5321 to be described below, and more particularly, is lower than 8 wt %. In contrast, as the non-magnetic material for coating the surface of the image region 5321, for example, aluminum or a nickel-phosphorus alloy having a medium phosphorus content may be used. Here, in the nickel-phosphorus alloy having a medium phosphorus content, the phosphorus content is higher than that of the nickel-phosphorus alloy used in the aforementioned non-image regions 5322, and more particularly, is equal to or higher than 8 wt %.

As described above, in the nickel-phosphorus alloys, magnetism is determined according to the phosphorus content. For this reason, by adjusting the phosphorus content, it is possible to coat the surfaces of the non-image regions 5322 and the surface of the image region 5321. Since the developing sleeve 532 can be manufactured in few processes, it is possible to reduce a manufacturing cost of the developing sleeve 532.

The technology for disposing the seal members at the opposite ends of the developing sleeve in the rotation axis direction of the developing sleeve in order to inhibit the magnetic toner on the circumferential surface of the developing sleeve from moving to the ends in the rotation axis direction and causing toner leakage is known. However, even when this technology is used, the toner layers are disturbed at the opposite ends of the developing sleeve, causing scattering of the magnetic toner or fog of the magnetic toner at an end.

In contrast, in the developing device 122 according to the embodiment of this disclosure, the surfaces of the non-image regions 5322 located at the opposite ends of the developing sleeve 532 in the rotation axis direction of the developing sleeve 532 are coated with the magnetic material. Thereby, it is possible to stably hold the magnetic toner at the opposite ends of the developing sleeve 532. Thus, it is possible to suppress the scattering or end fog of the magnetic toner resulting from the disturbance of the toner layer at the opposite ends of the developing sleeve 532.

Further, only the non-image regions 5322 are coated with the magnetic material, and the other image region 5321 is coated with the non-magnetic material. As such, the magnetic toner on the developing sleeve 532 is not hindered from moving onto the photosensitive drum 121. In addition, since the base of the developing sleeve 532 which is formed of a non-magnetic material such as aluminum is coated with the non-magnetic material, mechanical strength of the developing sleeve 532 can be enhanced.

In addition to the aforementioned constitution, in the developing device 122 according to the present embodiment, in order to prevent the magnetic toner from leaking out at the opposite ends of the developing sleeve 532, the seal members 82 are provided at the positions facing the opposite ends of the developing sleeve 532. To be specific, as illustrated in FIGS. 5 and 6 above, the seal members 82 are disposed opposite to the circumferential surfaces of the non-image regions 5322 of the developing sleeve 532. The magnetic brushes are formed between the seal members 82 and the magnetic roller 531, and the movement of the magnetic toner toward the ends of the developing sleeve 532 is regulated by the magnetic brushes.

Here, when the surfaces of the non-image regions 5322 of the developing sleeve 532 are formed of a non-magnetic material, magnetic restraint imposed on the magnetic toner in the non-image regions 5322 is weak, and thus the magnetic toner is easily charged up in the non-image regions 5322. As a result, the toner layers of the non-image regions 5322 are widened, and the scattering or end fog of the magnetic toner may occur In contrast, in the present embodiment, the surfaces of the non-image regions 5322 are formed of a magnetic material. Thereby, magnetic restraint imposed on the magnetic toner in the non-image regions 5322 is strong, and the magnetic toner can be stably held, thus preventing the magnetic toner from being charged up in the non-image regions 5322. For this reason, the toner layers of the non-image regions 5322 do not widen, and the scattering or end fog of the magnetic toner can be suppressed.

This disclosure is not limited to the constitutions of the above embodiments, and various modifications thereof are possible. The constitution illustrated in each of the above embodiments using FIGS. 1 to 6 is merely an embodiment of this disclosure, and the constitution of this disclosure is not limited thereto.

For example, in the above embodiments, the example in which the surface of the image region 5321 of the developing sleeve 532 is coated with the non-magnetic material has been described, but this disclosure is not necessarily limited thereto. If the base of the developing sleeve 532 is formed of a non-magnetic material, the surface thereof may not be coated with a non-magnetic material. However, as mentioned in the above embodiments, from the viewpoint of enhancing the mechanical strength of the developing sleeve 532, the surface of the image region 5321 is preferably coated with the non-magnetic material.

Further, to further enhance the mechanical strength of the developing sleeve 532, the entire surface of the developing sleeve 532 may be further coated using chromium plating in addition to the coating mentioned in the above embodiments.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing device comprising a developing roller, which includes a magnetic roller configured to have multiple magnetic poles in a circumferential direction thereof and a roller-shaped developing sleeve sheathed on the magnetic roller and supplies magnetic toner to a photosensitive drum, wherein the developing sleeve is configured such that a surface of an image region thereof, which is located in an intermediate portion thereof in a rotation axis direction thereof and which supplies the magnetic toner to the photosensitive drum, is coated with a non-magnetic material, and such that surfaces of non-image regions thereof, which are located at opposite ends thereof in the rotation axis direction and which supply no magnetic toner to the photosensitive drum, are coated with a magnetic material, the non-magnetic material coating the surface of the image region is a nickel-phosphorus alloy, and the magnetic material coating the surfaces of the non-image regions is nickel or a nickel-phosphorus alloy having a lower phosphorus content than the nickel-phosphorus alloy coating the surface of the image region.

2. The developing device according to claim 1, further comprising seal members disposed opposite to circumferential surfaces of the non-image regions.

3. The developing device according to claim 2, wherein the seal members are disposed in non-contact with the circumferential surfaces of the non-image regions, and inhibit the magnetic toner on the circumferential surface of the developing sleeve from moving to the ends in the rotation axis direction with magnetic brushes formed between the magnetic roller and the seal members.

4. The developing device according to claim 1, wherein the phosphorus content of the nickel-phosphorus alloy coating the surface of the image region is equal to or higher than 8 [wt %].

5. The developing device according to claim 1, wherein the developing sleeve includes a cylindrical base which is formed of the non-magnetic material and whose surface is coated with the non-magnetic material and the magnetic material.

6. The developing device according to claim 1, wherein the surface of the image region which is coated with the non-magnetic material and the surfaces of the non-image regions which are coated with the magnetic material are further coated with chromium.

7. An image forming apparatus comprising:

a photosensitive drum, on a surface of which a toner image is formed;

a charging unit configured to charge the surface of the photosensitive drum;

an exposing unit configured to expose the surface of the photosensitive drum which is charged by the charging unit to form an electrostatic latent image; and the developing device according to claim 1, configured to supply magnetic toner to the electrostatic latent image formed by the exposing unit to form a toner image.

8. A developing device comprising a developing roller, which includes a magnetic roller configured to have multiple magnetic poles in a circumferential direction thereof and a roller-shaped developing sleeve sheathed on the magnetic roller and supplies magnetic toner to a photosensitive drum, wherein the developing sleeve is configured such that a surface of an image region thereof, which is located in an intermediate portion thereof in a rotation axis direction thereof and which supplies the magnetic toner to the photosensitive drum, is coated with a non-magnetic material, and such that surfaces of non-image regions thereof, which are located at opposite ends thereof in the rotation axis direction and which supply no magnetic toner to the photosensitive drum, are coated with a magnetic material, and the surface of the image region which is coated with the non-magnetic material and the surfaces of the non-image regions which are coated with the magnetic material are further coated with chromium.

9. The developing device according to claim 8, further comprising seal members disposed opposite to circumferential surfaces of the non-image regions.

10. The developing device according to claim 8, wherein the seal members are disposed in non-contact with the circumferential surfaces of the non-image regions, and inhibit the magnetic toner on the circumferential surface of the developing sleeve from moving to the ends in the rotation axis direction with magnetic brushes formed between the magnetic roller and the seal members.

11. The developing device according to claim 8, wherein:

the non-magnetic material coating the surface of the image region is a nickel-phosphorus alloy; and the magnetic material coating the surfaces of the non-image regions is nickel or a nickel-phosphorus alloy having a lower phosphorus content than the nickel-phosphorus alloy coating the surface of the image region.

12. The developing device according to claim 8, wherein the phosphorus content of the nickel-phosphorus alloy coating the surface of the image region is equal to or higher than 8 [wt %].

13. The developing device according to claim 8, wherein the developing sleeve includes a cylindrical base which is formed of the non-magnetic material and whose surface is coated with the non-magnetic material and the magnetic material.

14. An image forming apparatus comprising:

a photosensitive drum, on a surface of which a toner image is formed;

a charging unit configured to charge the surface of the photosensitive drum;

an exposing unit configured to expose the surface of the photosensitive drum which is charged by the charging unit to form an electrostatic latent image; and the developing device according to claim 8, configured to supply magnetic toner to the electrostatic latent image formed by the exposing unit to form a toner image.

* * * * *